United States Patent [19]

Hemus

[11] Patent Number: 4,894,104

[45] Date of Patent: Jan. 16, 1990

[54] METHOD AND APPARATUS FOR SEALING CARTONS

[75] Inventor: David S. Hemus, Cirencester, England

[73] Assignee: MB Group plc, Reading, England

[21] Appl. No.: 277,265

[22] Filed: Nov. 29, 1988

[30] Foreign Application Priority Data

Dec. 17, 1987 [GB] United Kingdom ..... 8729478

[51] Int. Cl.[4] ..... B32B 31/20

[52] U.S. Cl. ..... 156/152; 53/375; 53/388; 53/491; 156/227; 156/291; 156/443; 156/497; 156/499; 493/131; 493/151

[58] Field of Search ..... 53/375, 388, 491; 156/152, 291, 497, 499, 227, 443; 493/131, 151

[56] References Cited

U.S. PATENT DOCUMENTS 3,884,130 5/1975 Stolkin et al. ..... 493/131 X
4,367,117 1/1983 Seaborn ..... 156/443
4,636,185 1/1987 Carter et al. ..... 493/151 X
4,676,860 6/1987 Lee et al. ..... 156/227 X

*Primary Examiner*—Robert A. Dawson
*Attorney, Agent, or Firm*—Burns, Doane, Swecker & Mathis

[57] ABSTRACT

A method and apparatus for sealing cartons by sticking together facing surfaces of a hinged flap and a wall of each carton by means of a solvent-based, preferably water-based, adhesive, in which the cartons are continuously moved along a line past an adhesive applicator which applies a deposit of adhesive to the under surface of the flap, first pressure rollers arranged to bring the flap surface temporarily into contact with the side wall to transfer some of the adhesive to it and to thin out and spread the adhesive on the flap, a hot air nozzle which enters within the acute angle formed between the two surfaces when the flap is released from the first pressure rollers and which directs hot air onto the surfaces to effect partial drying of the adhesive, and a second set of pressure rollers to press the flap against the side wall to effect final sealing.

12 Claims, 3 Drawing Sheets

METHOD AND APPARATUS FOR SEALING CARTONS

BACKGROUND OF THE INVENTION

1. Field of the Invention

The invention relates to a method and apparatus for sealing cartons by sticking together facing surfaces of a hinged flap and a wall of each carton using a solvent-based adhesive, in particular a water-based adhesive.

2. Description of the Prior Art

For sealing cartons, solvent-based adhesives have significant advantages of cost over known hot melt adhesives and water-based adhesives have a particular advantage in that it is unnecessary to provide for evacuation of the solvent to avoid undesirable environmental effects. However, the known solvent-based adhesives, and particularly water-based adhesives, require a significant drying time, e.g. of the order of 1 second, which has in the past limited the rate of production of sealed cartons using such adhesives.

In our prior British Pat. Specification No. 2,103,145 we have disclosed the use of a spray gun to apply an atomised spray of water-based adhesive to selected parts of the carton, the outlet from the spray gun being a nozzle controlled by a needle valve which cooperates with the nozzle to cause a swirling motion of the atomised spray of adhesive. The sprayed adhesive was partially dried by directing hot gas on to the selected parts which were then pressed against cooperating parts of the blank to seal them together by means means of the partially dried adhesive. The combination of application of the water-based adhesive as an atomised spray with a swirling motion, and its drying by hot air, enabled rapid and effective adhesion of the selected and cooperating parts of the carton to be made, but problems were encountered in practice because the spray nozzles tended to clog and had to be cleared frequently.

SUMMARY OF THE INVENTION

It is an object of the present invention to provide a method and apparatus for sealing cartons using a solvent-based, particularly a water-based adhesive, which can be operated reliably and effectively at a high rate.

According to the present invention, in a method of sealing a carton by sticking together facing surfaces of a hinged flap and a wall of the carton using a solvent based adhesive, a deposit of the adhesive is applied to one of the surfaces, the two surfaces are then brought together to transfer some of the adhesive to the other of the surfaces and to thin out and spread the deposit of adhesive on the first-mentioned surface, the surfaces are separated so as to lie at an acute angle to one another, hot air is directed on to the surfaces to effect partial drying of the adhesive, and the surfaces are then pressed together to stick them to one another.

The adhesive used is preferably water-based, e.g. a water-dispersed polyvinylacetate adhesive. The adhesive may be applied by extrusion, wiping, rolling or as a jet, and may be deposited on the said one of the surfaces in the form of spots or beads or a stripe.

In practical application of the invention, preferably the carton is moved continuously along a line past an adhesive applicator, first pressure means for bringing the two surfaces temporarily together, a hot air nozzle disposed so as to lie within the acute angle between the two separated surfaces, and second pressure means to press the two surfaces together again.

In the case in which the flap is hinged to an adjacent panel of the carton and stuck to a side wall, the first and second pressure means preferably act on the flap to press it against the side wall and the surfaces are separated after passing the first pressure means by the resilience of the carton material.

The outside of the flap may be cooled as its inner surface passes the hot air nozzle.

The invention also resides in apparatus for sealing cartons by sticking together facing surfaces of a hinged flap and a wall of each carton by means of a solvent-based adhesive, comprising a conveyor for moving the cartons continuously along a line beside which are arranged an adhesive applicator disposed so as to apply a deposit of adhesive to one of the surfaces, first pressure means arranged to bring the two surfaces temporarily together so as to transfer some of the adhesive to the other of the surfaces and to thin out and spread the adhesive on the first mentioned surface, a hot air nozzle disposed so as to lie within an acute angle formed between the two surfaces when released from the first pressure means and to direct hot air on to the surfaces to effect partial drying of the adhesive, and second pressure means arranged to press the two surfaces together to stick them to one another.

Preferably the first pressure means comprises a set of rollers acting on the flap and an adjacent panel to which it is hinged, the rollers contacting the flap and adjacent panel on either side of the hinge line which joins them. The second pressure means also preferably comprises a set of rollers acting on the outside of the flap opposite to the deposit of adhesive.

A cooling water pipe is preferably disposed so as to run parallel with the conveyor and to contact the outer surface of the flap when it is released from the first pressure rollers to effect cooling of the outer surface of the flap and to restrict its angle of separation from the side wall.

DETAILED DESCRIPTION OF THE INVENTION

Figure 1:
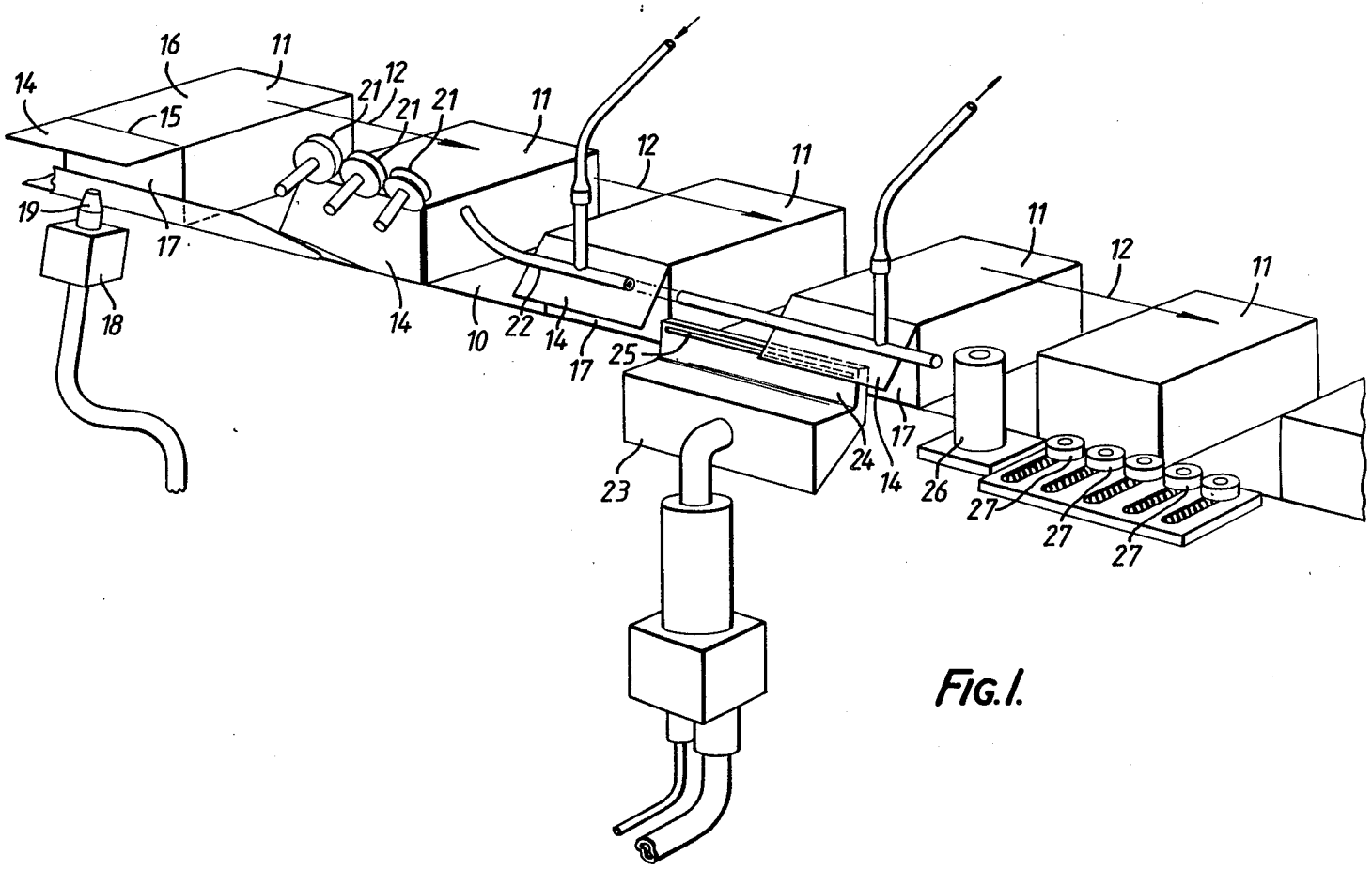
FIG. 1 is a diagrammatic perspective view of an apparatus operating in accordance with the invention.
Figure 2:
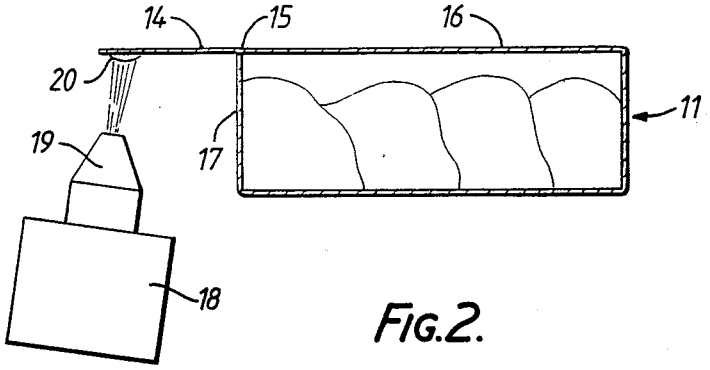
FIG. 2 is a diagrammatic cross section through a carton showing application of adhesive thereto.
Figure 3:
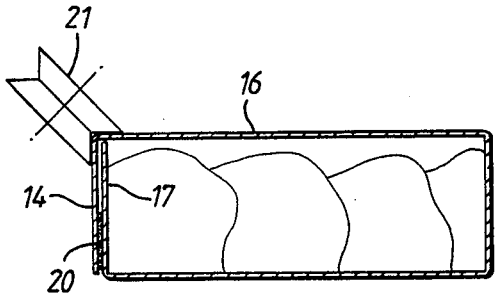
FIG. 3 is a similar cross-section illustrating how the first pressure means bring the surfaces together.

As shown in FIG. 1, a conveyor 10 is arranged to move cartons 11 continuously along a line in the direction of arrows 12. Each carton 11 has a flap 14 hinged along line 15 to an adjacent panel 16, which may be a hinged lid of the carton. The flap 14 initially extends horizontally as shown at the left hand side of FIG. 1 and it is to be brought down and stuck to the side wall 17 to seal the carton. A similar flap (not shown) may be provided at the other side of the carton.

An adhesive applicator 18 is disposed beside the conveyor 10 and provided with a nozzle 19 through which a jet of adhesive can be directed against the underside of the flap 14 to apply a deposit 20 of adhesive thereon in the form of spots or a bead or stripe.

After passing the adhesive applicator 18, the carton reaches the first set of pressure rollers 21 which are of V section and mounted on axes inclined to the vertical so as to bend the flap 14 down until its inner surface is brought up against the surface of the side wall 17. As a result, some of the adhesive is transferred to the surface of the side wall 17 and the deposit 20 is thinned out and spread over the surface of the flap 14.

Figure 4:
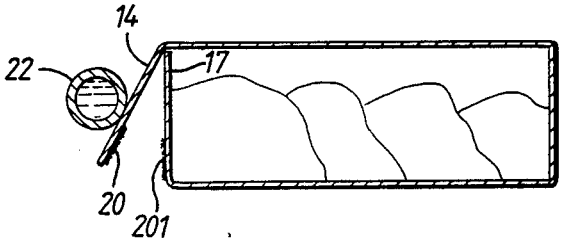
FIG. 4 is a similr cross-section illustrating the separation of the surfaces after release from the first pressure means.
Figure 5:
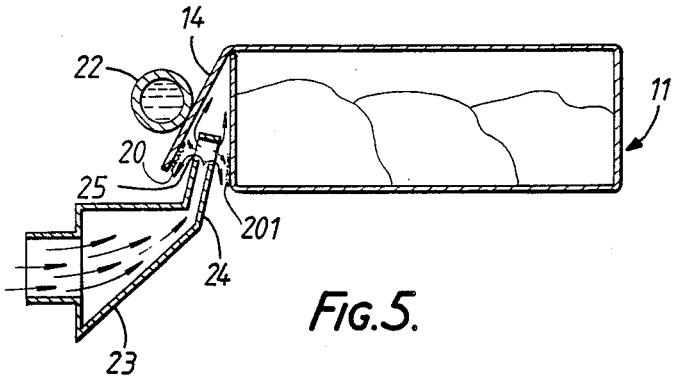
FIG. 5 is a similar cross-section illustrating the hot air drying of the adhesive.
Figure 6:
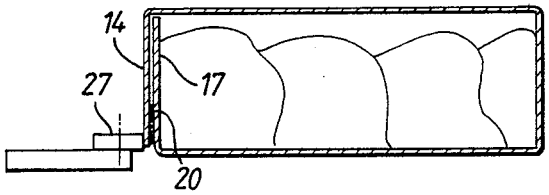
FIG. 6 is a similar cross-section illustrating the final pressing together of the surfaces to seal the carton.

After passing pressure rollers 21 and being released therefrom, the flap 14 springs back due to the resilience of the carton material to a position as shown in FIG. 4 in which the surfaces of the flap 14 and side wall 17 are separated at an acute angle. A cooling water tube 22, which also serves as a guide bar, is provided at this point to restrict the angle of separation from the side wall and to effect cooling of the outer surface of the flap.

The carton 11 now reaches a hot air drying device 23 having a longitudinally extending nozzle 24 with slot outlets 25 on each side. The nozzle 24 is so disposed as to enter within the acute angle formed between the surfaces of the flap 14 and side wall 17 and to direct the hot air on to these surfaces so as to effect partial drying of the adhesive deposits 20, 201 on the two surfaces. The hot air drying results in evaporation of the solvent e.g. water, in the adhesive, leaving the adhesive ready for instant adhesion.

The carton 11 now passes to the second pressure means consisting of a first relatively large diameter roller 26 on a vertical axis which folds the flap 14 back against the side wall 17 and a set (five as shown) of smaller rollers 27 which press the lower portion of the flap 14 carrying the adhesive deposit 20 against the corresponding adhesive-carrying part of the side wall 17 so as to stick them finally together and complete sealing of the carton.

Although the resilience of the carton material is usually adequate to provide for the separation of the flap and side wall after release from the first pressure rollers 21, it is possible also to provide a thin blade (not shown) to effect separation. Also, in one possible modification of the described embodiment, the pressure rollers 21 are replaced by a plough rail.

Although the accompanying drawings illustrate the closing of a flap on one side only of the carton, it is possible to duplicate the apparatus on the other side of the conveyor 10 so as to provide for simultaneous closure of flaps at both sides of the carton. Furthermore, it is possible to apply the adhesive to the carton wall(s) instead of to the flap(s). The applicator may apply the adhesive in any suitable way, e.g. by extrusion, wiping, rolling or as a jet.

The method and apparatus illustrated enable cartons to be sealed using a water-based adhesive at high speed and in a reliable manner. The arrangement for transfer and spreading of the adhesive is of advantage in dealing with difficult carton materials such as coated boards and boards having finishes with additives which may make adhesion difficult. The arrangement described avoids problems of clogging and enables the apparatus to be used with a wide range of adhesives.

I claim:

1. A method of sealing a carton by sticking together facing surfaces of a hinged flap and a wall of the carton using a solvent-based adhesive, wherein a deposit of the adhesive is applied to one of the surfaces, the two surfaces are then brought together to transfer some of the adhesive to the other of the surfaces and to thin out and spread the deposit of adhesive on the first-mentioned surface, the surfaces are separated so as to lie at an acute angle to one another, hot air is directed on to the surfaces to effect partial drying of the adhesive, and the surfaces are then pressed together to stick them to one another.

2. A method according to claim 1 wherein the adhesive used is water-based.

3. A method according to claim 2 wherein the adhesive used is a water-dispersed polyvinylacetate adhesive.

4. A method according to claim 1 wherein the adhesive is applied by extrusion, wiping, rolling or as a jet.

5. A method according to claim 4 wherein the adhesive is deposited on the said one of the surfaces in the form of spots or beads or a stripe.

6. A method according to claim 1 wherein the carton is moved continuously along a line past an adhesive applicator, first pressure means for bringing the two surfaces temporarily together, a hot air nozzle disposed so as to lie within the acute angle between the two separated surfaces, and second pressure means to press the two surfaces together again.

7. A method according to claim 6 in which the flap is hinged to an adjacent panel of the carton and stuck to a side wall, wherein the first and second pressure means act on the flap to press it against the side wall and the surfaces are separated after passing the first pressure means by the resilience of the carton material.

8. A method according to claim 7 wherein the outside of the flap is cooled as its inner surface passes the hot air nozzle.

9. Apparatus for sealing cartons by sticking together facing surfaces of a hinged flap and a wall of each carton by means of a solvent-based adhesive, comprising a conveyor for moving the cartons continuously along a line beside which are arranged an adhesive applicator disposed so as to apply a deposit of adhesive to one of the surfaces, first pressure means arranged to bring the two surfaces temporarily together so as to transfer some of the adhesive to the other of the surfaces and to thin out and spread the adhesive on the first mentioned surface, a hot air nozzle disposed so as to lie within an acute angle formed between the two surfaces when released from the first pressure means and to direct hot air on to the surfaces to effect partial drying of the adhesive, and second pressure means arranged to press the two surfaces together to stick them to one another.

10. Apparatus according to claim 9 wherein the first pressure means comprises a set of rollers acting on the flap and an adjacent panel to which it is hinged, the rollers contacting the flap and adjacent panel on either side of the hinge line which joins them.

11. Apparatus according to claim 9 wherein the second pressure means comprises a set of rollers acting on the outside of the flap opposite to the deposit of adhesive.

12. Apparatus according to claim 10, wherein a cooling water pipe is disposed so as to run parallel with the conveyor and to contact the outer surface of the flap when it is released from the first pressure rollers to effect cooling of the outer surface of the flap and to restrict its angle of separation from the side wall.

* * * * *